United States Patent [19]

Tenser et al.

[11] Patent Number: 4,535,577

[45] Date of Patent: Aug. 20, 1985

[54] OFFICE PANELLING SYSTEM

[75] Inventors: Adrian Tenser, Markham, Canada; Alfred J. Prizlow; Gerald I. Peters, both of Warren, Mich.

[73] Assignee: Global Upholstery Company Limited, Downsview, Canada

[21] Appl. No.: 448,401

[22] Filed: Dec. 15, 1982

[51] Int. Cl.[3] ..... E04F 19/06; E04F 19/08

[52] U.S. Cl. ..... 52/221; 52/242; 52/238.1; 174/48

[58] Field of Search ..... 52/238.1, 243.1, 239, 52/240, 241, 242, 586, 578–581, 127.9, 220, 221, 36, 508; 160/135, 231; 16/225–227, 382; 264/318; 174/48, 49

[56] References Cited

U.S. PATENT DOCUMENTS

| | | | |
|---|---|---|---|
| 1,876,528 | 9/1932 | Walters | 52/508 |
| 1,990,259 | 2/1935 | Walters | 52/508 |
| 2,114,387 | 4/1938 | Killion | 52/220 |
| 2,114,388 | 4/1938 | Killion | 52/220 |
| 2,363,233 | 11/1944 | Dalton | 52/586 |
| 2,679,700 | 1/1954 | Urbain | 52/36 |
| 3,195,698 | 7/1965 | Codrea | 52/242 |
| 3,421,459 | 1/1969 | Sherwood | 52/243.1 |
| 3,425,171 | 2/1969 | Propst et al. | 52/36 |
| 3,486,287 | 12/1969 | Guillon | 52/495 |
| 3,592,289 | 7/1971 | Aysta | 52/656 |
| 3,695,330 | 10/1972 | Hasbrouck | 16/225 |
| 3,987,144 | 10/1976 | Nickold | 264/318 |
| 3,990,204 | 11/1976 | Haworth et al. | 52/242 |
| 4,060,294 | 11/1977 | Haworth et al. | 52/239 |
| 4,133,153 | 1/1979 | Hage | 52/242 |
| 4,144,924 | 3/1979 | Vanden Hoek | 160/231 |
| 4,223,500 | 9/1980 | Clark et al. | 52/127.9 |
| 4,232,724 | 11/1980 | Brown | 160/231 |
| 4,344,475 | 8/1982 | Frey | 160/135 |
| 4,356,672 | 11/1982 | Beckman et al. | 52/36 |

FOREIGN PATENT DOCUMENTS

| | | | |
|---|---|---|---|
| 1024324 | 1/1978 | Canada . | |
| 1058371 | 7/1979 | Canada . | |
| 1190491 | 3/1959 | France | 16/382 |
| 2060022 | 4/1981 | United Kingdom | 52/239 |
| 2069212 | 8/1981 | United Kingdom | 160/135 |

*Primary Examiner*—James L. Ridgill, Jr.

[57] ABSTRACT

According to the present application, a modular office panelling system is disclosed which provides increased flexibility in office layout. Each panel is generally rectangular and securable to adjacent panels along the vertically opposing edges via a flexible plastic hinge. Stacked panels are secured as a unit by structural members which extend between the panels. These members are slidably received in endcaps of the panels thereby simplifying field installation of the system. Each panel of the system is designed about a steel framework which releasably supports decorative panels to either side of the framework. The framework has a number of apertures to allow wiring to pass therethrough, concealed by the decorative panels. In addition, the structure of the present panelling system permits the hanging of display cabinets and other equipment substantially along the entire upper edge of each panel.

4 Claims, 16 Drawing Figures

FIG. 8.
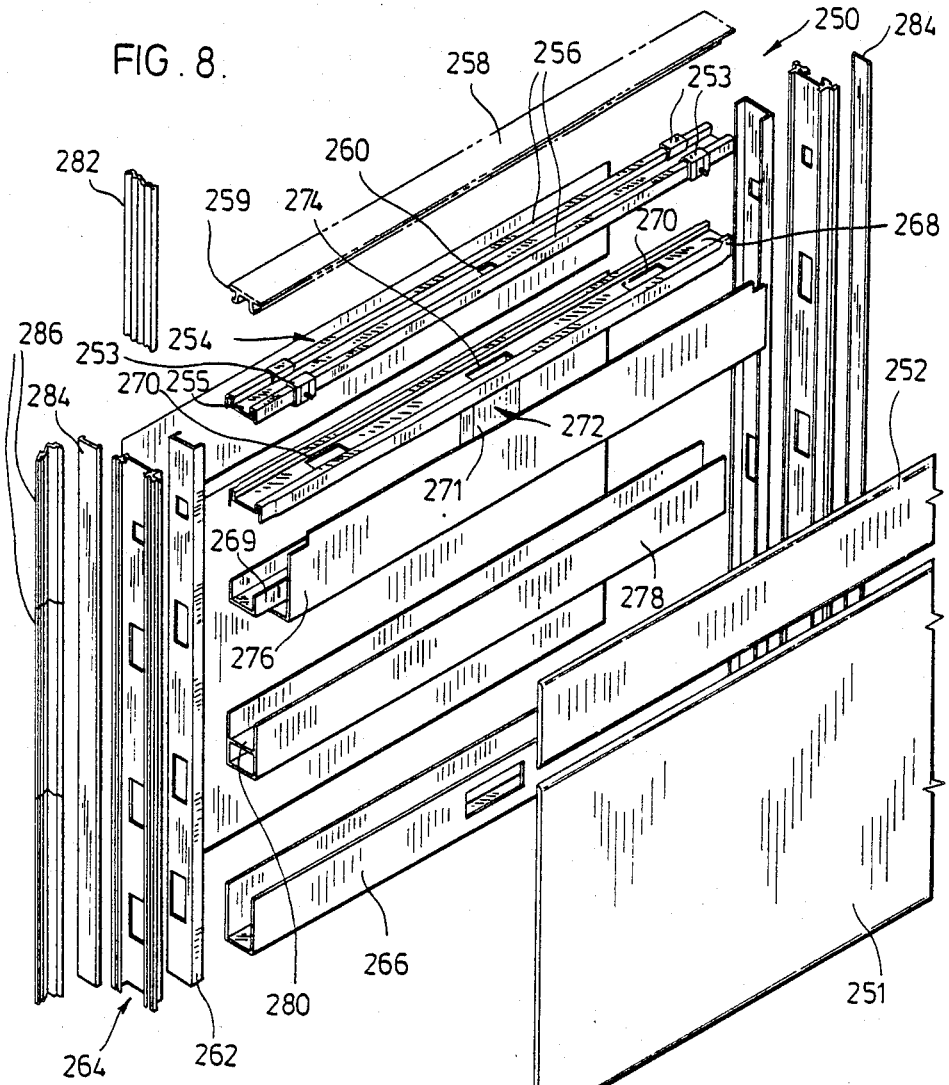
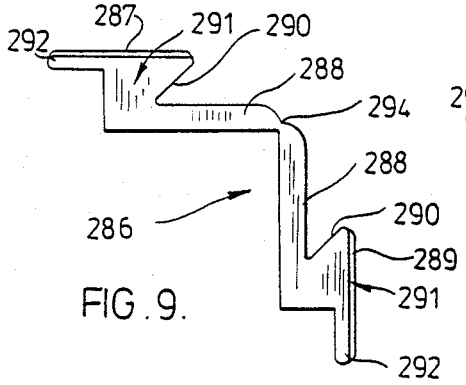
FIG. 9.
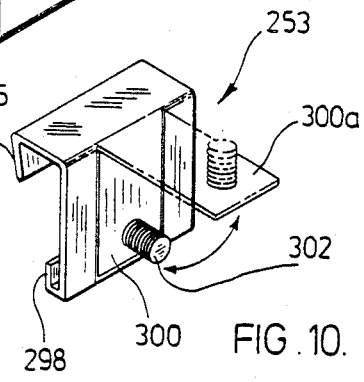
FIG. 10.

FIG. 13.
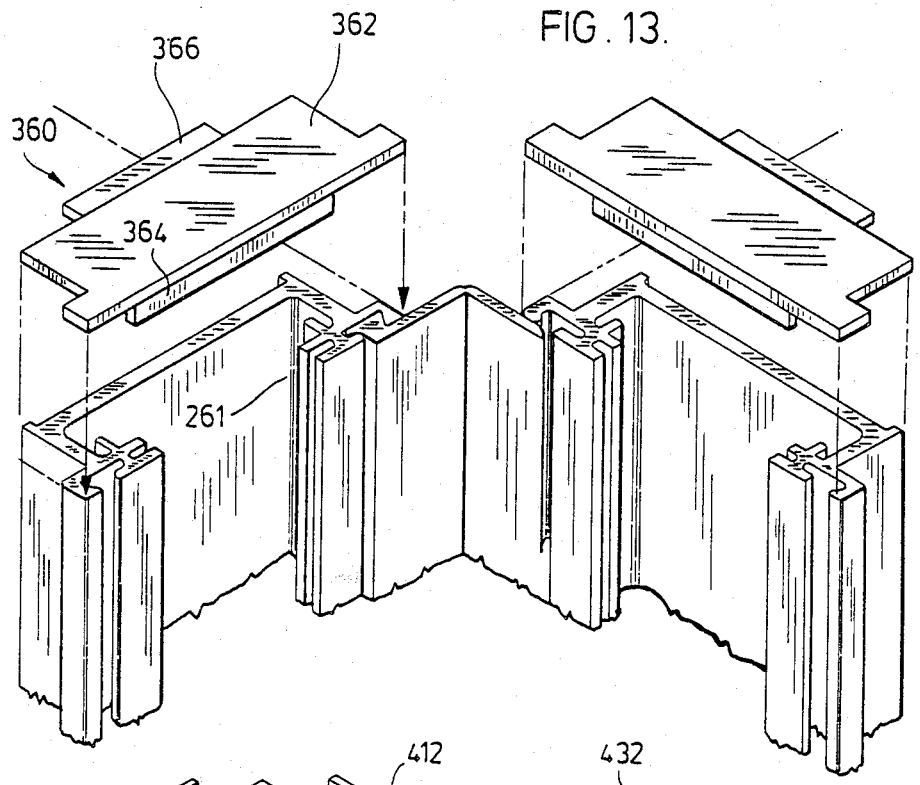
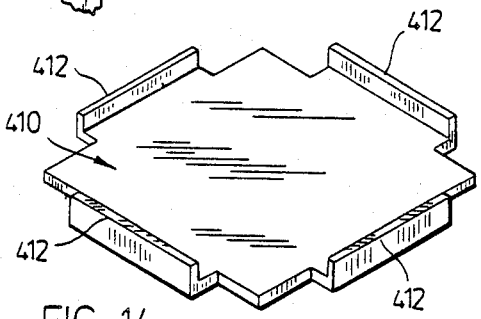
FIG. 14.
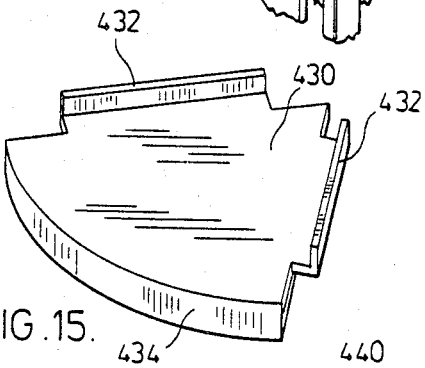
FIG. 15.
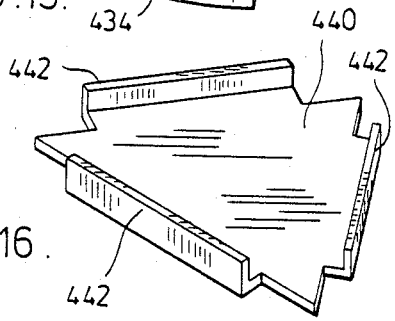
FIG. 16.

OFFICE PANELLING SYSTEM

FIELD OF THE INVENTION

The present invention relates to an office panel system formed from a plurality of interconnected panels or partitions and in particular to an improved panel structure which provides increased flexibility and ease of use.

BACKGROUND OF THE INVENTION

Wall systems or office panelling systems formed from a plurality of interconnected pre-fabricated and portable panels are well known. Such systems are being extensively used to subdivide office space in new buildings to define smaller work areas which are physically separated. Initially, systems of this type were introduced as an economical alternative for dividing large office space into smaller working units, however their popularity has increased due to the flexibility and the reduced cost in rearranging the office space at times of corporate restructuring. The emphasis has shifted from a low cost method of dividing office space to a method of dividing office space into workable units having a pleasant appearance and the capability of being easily varied from time to time.

Normally, the panels are connected by flexible hinges in order to maintain alignment of the panels and to further allow the panels to be angled relative to one another. This provides a great deal of flexibility with respect to the horizontal modularity of office panelling systems however, little attention has been directed to the need to provide an office panelling system which is modular in the vertical direction. In order to provide an office panelling system which is acceptable to corporations, the system must not only divide the space in a manner which allows flexibility but it should also provide electrical power in an easy and convenient fashion. It should also allow communication lines to be provided at various points in the system. Furthermore, the structure should be capable of receiving hanging equipment designed to simplify particular job functions. Due to the increased sophistication of the user, the office panelling system should now fulfill all the requirements of office automation and be compatible with equipment being used in office automation.

The following patents disclose various types of office panelling systems which generally use flexible hinges for reception within extruded endcaps of office panels. Canadian Pat. No. 1,024,324, Canadian Pat. No. 1,058,371, U.S. Pat. Nos. 3,425,171; 3,592,289; 3,990,204; 4,060,294 and 4,133,153.

U.S. Pat. No. 4,133,153 discloses electrical raceways provided at the base of the panel to facilitate the transmission of electrical power through the office panels. U.S. Pat. No. 4,060,294 is a more sophisticated structure which has a particular logic system for the prewired panels and sockets are provided at the base of the panel for connecting various office equipment such as typewriters and printers. U.S. Pat. No. 3,990,204 is typical of patents which generally show the use of flexible hinges in combination with extruded endcaps which are applied to the panels. In addition to these patents which generally show the use of free standing office panels, there is another system marketed which is based on a beam supported generally at desk height with this beam being capable of supporting additional partitions above. This system provides a positive support surface above floor level to which partitions are added above between columns secured to the beam. Another example of a wall dividing system is disclosed in U.S. Pat. No. 3,486,287 which shows vertical modularity between columns which extend from the floor to the ceiling. As can be appreciated, it is not always desirable to have the columns extend from the floor to ceiling and the advantages of vertical modularity are not realized as the resulting product has poor visual appeal.

The structure of the present invention seeks to overcome the disadvantages of the prior art systems while still providing an office panelling system which is easily assembled, easily varied, and compatible with the requirements of office automation.

SUMMARY OF THE INVENTION

An office panelling system, according to the present invention, comprises a plurality of panels secured to horizontally adjacent panels by first joining members. Each panel includes means for cooperating with a second panel to positively secure the second panel atop said first panel in an aligned manner, such that the height of the panelling system is variable. The panels can be secured in the stacked relationship prior to assembly of the system.

According to an aspect of the present invention, a panelling system comprises a plurality of generally rectangular panels securable to horizontally adjacent panels along the vertical opposing edges with each panel including means for receiving a support member proximate the ends of said panel whereby a second panel may be positively secured atop a first panel by two structural members extending between the stacked panels.

According to an aspect of the invention the office panelling system comprises a plurality of similar panels joined together by flexible hinges, each panel having a body portion to which extruded endcaps are secured. Each of the endcaps include two parallel slots running approximately the height of the panel for securing the hinges. The endcaps are secured to opposite ends of the body and in combination allow securement of adjacent panels along opposing ends. Each panel is adapted to receive additional panels atop thereof such that the office panelling system is vertically adjustable by stacking panels. The stacked panels are secured by structural members extending between the panels.

According to a further aspect of the invention an office panelling system comprise a plurality of similar panels joined together by flexible hinges with each panel having a steel framework to which extruded endcaps are secured. The endcaps include slots for securing hinges and the endcaps are secured to opposite sides of the frame. These endcaps allow securement of adjacent panels along opposing sides and each panel is capable of being secured to an adjacent panel by a flexible hinge. Each panel is further adapted to receive additional panels atop thereof to provide vertical adjustability with these stacked panels secured by structural members slidably received in the endcaps of the panels which transmit and distribute forces exerted on the panels.

According to yet a further embodiment of the invention, an office panelling system comprises a plurality of similar panels connectable to adjacent panels by at least one hinge strip, each panel having a generally rectangular frame including extruded endcaps secured along the ends of the frame. Each of these endcaps extends substantially over the full height of the panel and has two slots substantially the length of the panel for receiving the hinge strip. Each endcap has a slot for receiving a structural member having a generally C-shaped cross-section whereby the structural member when received in the first panel extends partially above the panel to be received in the endcap of a similar second panel positioned above the first panel. In this manner the panels are positively secured in a stacked relationship.

According to an aspect of the invention the injection molded hinge for use in an office panelling system is made of a plastic material and comprises two elongate body members joined by a web of reduced thickness relative to the body members. Each of the body members includes an engagement bead along the outer edge of the body member and generally extends in the length thereof. The engagement beads of the body members terminate at a different position in the length of the hinge to facilitate insertion of the hinge in a corresponding slot of an office panel.

According to an aspect of the invention a panel for an office panelling system comprises a generally rectangular frame made of steel to which extruded endcaps are secured on opposite sides of the frame. Two rectangular decorative members are provided and include means for releasably engaging the frame. These members are sized to approximately cover one side of the frame with an air space being defined between the members of sufficient size to allow telecommunication harnesses and electrical power cables to pass through the frame and concealed by the panels.

According to yet a further aspect of the invention an office panelling system comprises a plurality of similar panels with each panel having a generally rectangular steel framework with endcaps secured along the vertical edges of the panel. The endcaps include means for receiving one edge of a plastic hinge with the other edge of the hinge for engagement in an adjacent panel. Each endcap is adapted to receive a structural member which extends above the panel to be received in the endcap of a panel stacked above. In this manner stacked panels are secured relative to one another and the height of the office panelling system may be varied according to the number of stacked panels.

BRIEF DESCRIPTION OF THE DRAWINGS

Preferred embodiments of the invention are shown in the drawings wherein:

FIG. 8 is an exploded perspective view of a office panel with an alternate internal construction;

FIG. 9 is a section through a modified hinge strip;

FIG. 10 is a detail of an injection molded hinge suitable for securing one of the office decorative panels;

FIG. 13 is a partial exploded perspective view of the endcaps of two panels showing the locking engagement of a cap member for the extruded endcaps;

FIG. 14 is a modified corner cap for use in joining four panels located in a cross configuration;

FIG. 15 is a perspective view of an endcap used to join two panels at an angle;

FIG. 16 is a further endcap used to join three panels.

DETAILED DESCRIPTION OF THE PREFERRED EMBODIMENTS

Figure 1:
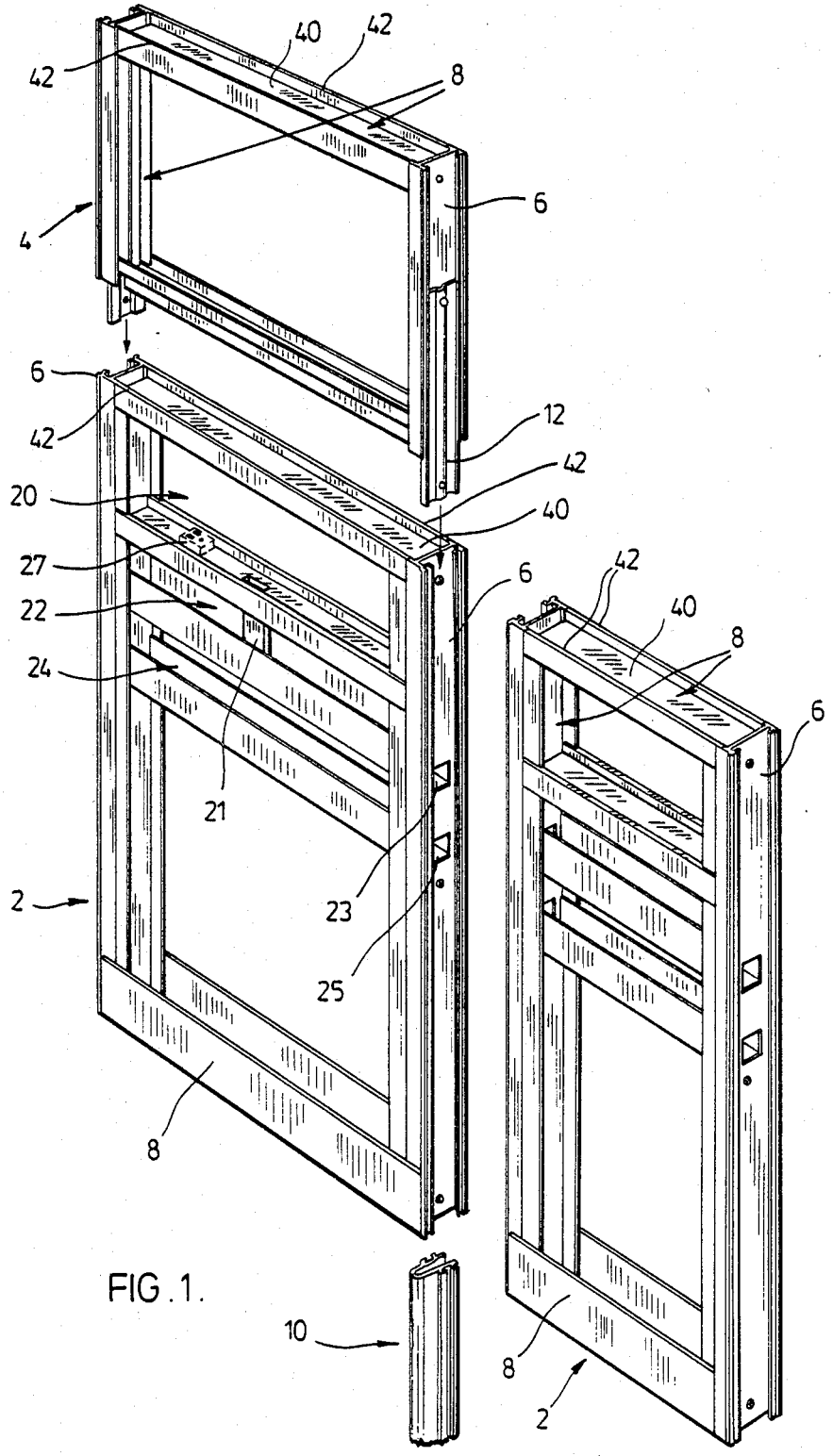
FIG. 1 is a perspective view illustrating three frames of the office panelling system.

As shown in FIG. 1, the base office panels 2 have a generally rectangular steel frame 8 to which extruded endcaps 6 are applied. One of these panels is shown with an upper panel 4 positioned to be stacked above the base unit 2. This upper panel also has a generally rectangular steel frame to which extruded caps 6 are applied. In order to connect the base panel to the upper panel, structural members 12 are slideably received within the endcap of both the upper and the base unit to positively secure the two panels. The upper panel can be removed from the base panel if it is vertically withdrawn. These members transmit and distribute forces exerted on the panels to the endcaps and subsequently to the steel frame.

The base panel 2 has three compartments 20, 22 and 24 which extend across the panel with the lower two compartments being used to allow the passage of electrical wiring harnesses and telecommunications wiring through the length of the panel. It is preferred that the compartment 22 is used for the electrical wiring and covers are normally applied to close the opening to provide an electrical conduit. In this case a passage way 21 is provided through the electrical conduit 22 to allow the telecommunication wiring to pass through the electrical conduit up to the upper compartment 20. As can be seen the ends of the panel have two apertures 23 and 25 to allow the electrical harness and telecommunication wiring to pass through connected panels. The upper compartment 20 has a number of receptacles 27 which are secured in the dividing structural member between compartment 20 and the electrical conduit compartment 22 for electrical connection to a power supply available in compartment 22 and to expose the receptacle within the upper compartment 20 to receive electrical plugs of office equipment. Thus electrical equipment may be connected to the electrical power supply via receptacle 27. Telecommunication wiring such as telephone wiring can be brought through the passage way 21 to compartment 20 and be directly connected. Preferrably compartment 20 is provided with a separate cover for ease of access.

The hinge member 10 is slideably received within the endcaps 6 and allows hinging of the panels relative to one another along the vertical axis of the hinge.

Figure 2:
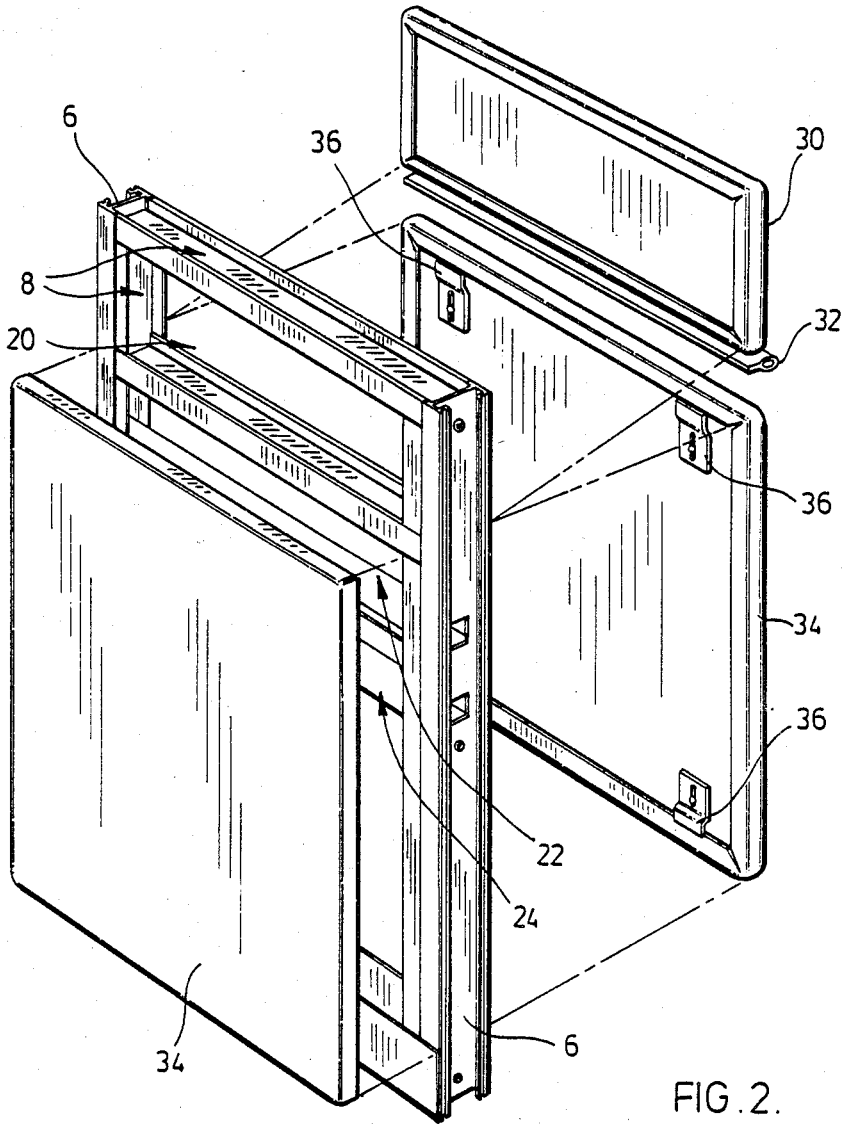
FIG. 2 is an exploded perspective view of a base panel including the frame member and the upholstered decorative panels.

In contrast to FIG. 1, FIG. 2 shows the base panel 2 including decorative panels 34 which have an upholstered outer surface. These members are adapted to releaseably engage the frame member 8 by means of clips 36 secured to the back of the members. The compartment 20 is covered either side by upper decorative members 30 (only one shown) which include an easily deformable resilient member 32 secured to the lower edge thereof. Member 30 can either be hingedly secured to the panel along its top edge or have other means which allows the easy removal thereof. Member 30 would be removed when a person wishes to connect any electrical equipment to the power source via the receptacles or to connect a telephone. The cord passes out of the lower edge of compartment 20 and resilient member 32 deforms in the area of the cord. In some circumstances member 30 will be connected to the panel by means of male and female snap connectors positioned at the corners of the member 30.

The base unit of the office panelling system is approximately 36 inches in height and power is accessible through a compartment 20 which is generally about 30 inches above floor level. Therefore, after member 30 has been removed, the office worker can connect the electrical equipment at approximately desk level, and any excess electrical cord may be stored in compartment 20. Similarly telecommunication equipment is connected at desk level as it is brought in through conduit 24 and allowed to pass through conduit 22 into the upper compartment via passage 21 shown in FIG. 1.

In assemblying the system, it is preferred to stack the panels as required and then join horizontally adjacent panels by inserting hinge 10.

Figure 3:
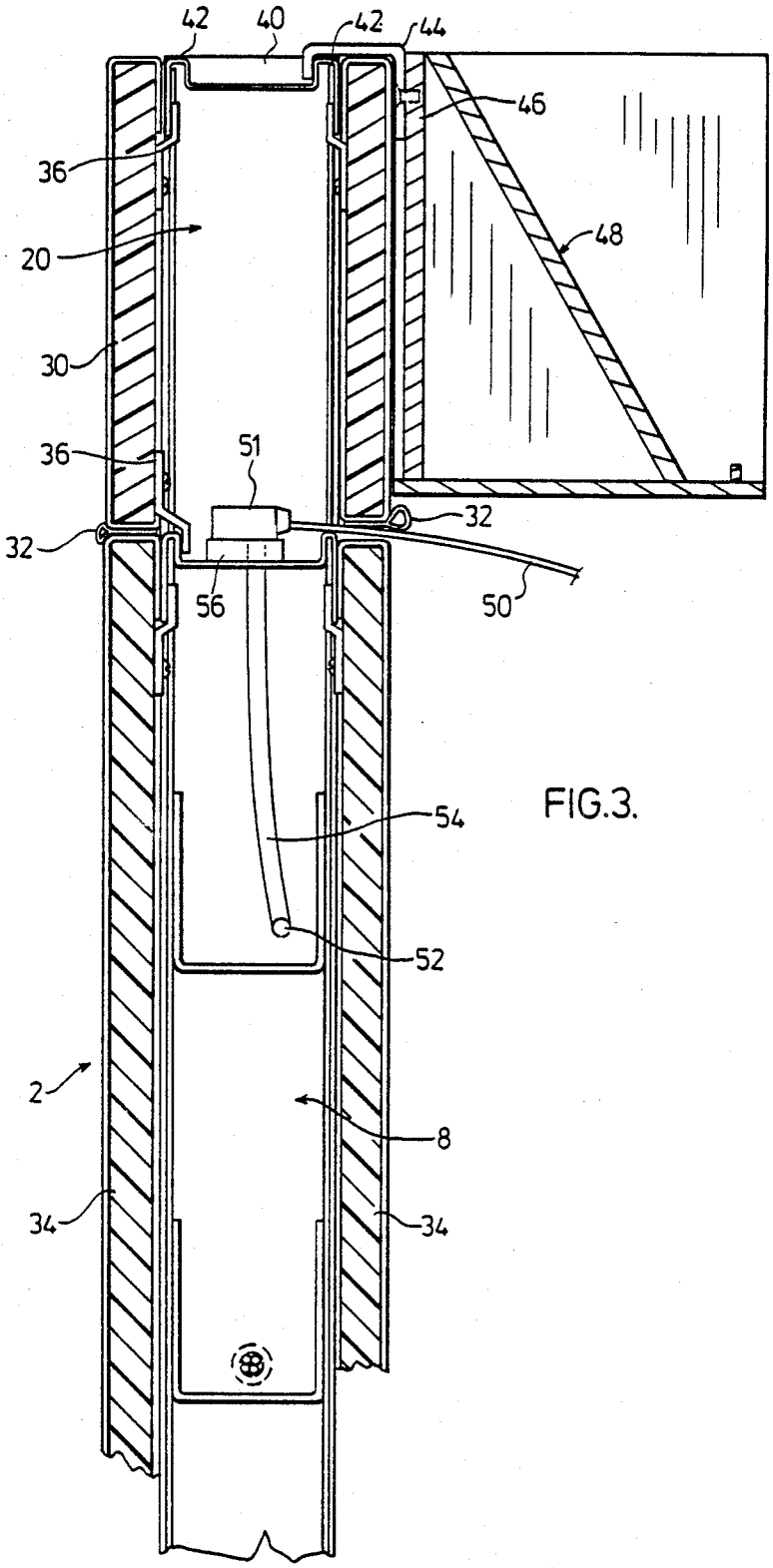
FIG. 3 is a partial vertical section through a base panel including a display unit hung to one side of the panel.

Further details of the system can be seen in FIG. 3 where to the left hand side of the panel two upholstered decorative members 34 and 30 are shown in engagement with the frame 8 of the panel concealing the electrical harness 52 and the feeder wires 54. As can be seen between the upper decorative panel members 30 and within compartment 20, a receptacle 56 is provided for receiving the plug 51 of an electric office machine. The cord 50 of this piece of equipment passes beneath the uppe member 30 and locally deforms the resilient member 32. In this way cords of electrical equipment can be connected to a power source within the office panel and the cord passes through the panel to the piece of equipment. Excess cord may be stored between the upper panels 30 within the compartment 20.

The top member of all panels is provided with two vertically extending lips 42 defining a generally recessed interior portion 40 shown in FIGS. 1, 2 and 3. These lips 42 allow the clip 44 to positively engage the office panel and support a filing cabinet or display case 48 to the exterior of the panel as shown in FIG. 3. As can be seen, a bracket 44 is connected by a screw or bolt arrangement to the rear face 46 of the piece of equipment 48 and a number of these brackets along the length of the component allow it to be hung along the length of the office panel. As these lips 42 extend the full length of the panel and are only discontinued at the ends of the panel, the office equipment may be hung at any point along the length of the panel and can even traverse two panels. In this manner the position of the component 48 relative to the office panel is quite variable and there is no requirement that the component be mechanically secured to an upright support column. This provides a high degree of variability with respect to the placement of accessory equipment.

In order to provide a finished top surface to the upper most stacked panels, plastic extruded top caps are used (not shown) which cover the recessed portion 40. This cap has downwardly extending leg portions which provide a press fit with the interior walls of the recess.

Figure 4:
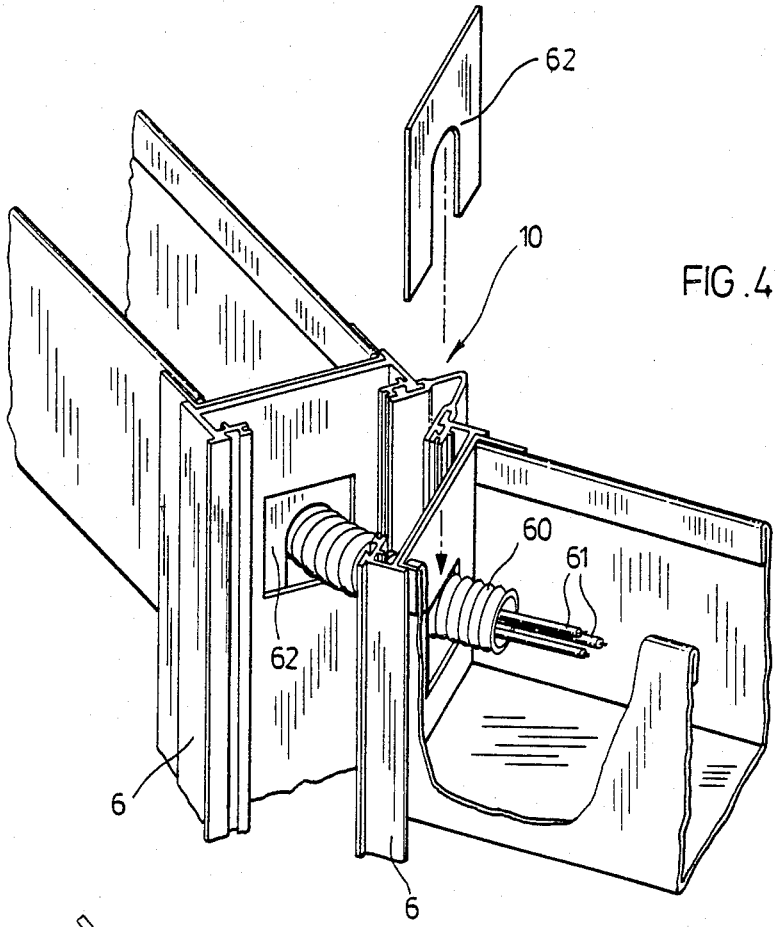
FIG. 4 is a partial perspective view of two panel frames having an electrical cable passing therebetween.

The panels as shown in FIG. 4 show one method of interconnecting the electrical conduits of two adjacent panels orientated at an angle relative to one another. In order to satisfy various electrical codes, a shielded cable is mechanically connected to adjacent panels which are angled relative to one another. This connection is capable of sustaining some stress which is required. In order to accomplish this, the shielded cable 60 used to join two adjacent panels is mechanically secured by clips 62 which cooperate with the interior wall of the end of each panel. The clips engage the ribs of the shielded cable and secure the cable within the panel. In this manner the individual wires 61 within the shielded cable are not exposed to stress. The actual electrical wiring harness within the conduit 22 can take many forms, however one particular advantageous wiring harness has a plurality of connectors which allow fast connection to receptacles which have a lower portion exposed to the conduit.

Figure 5:
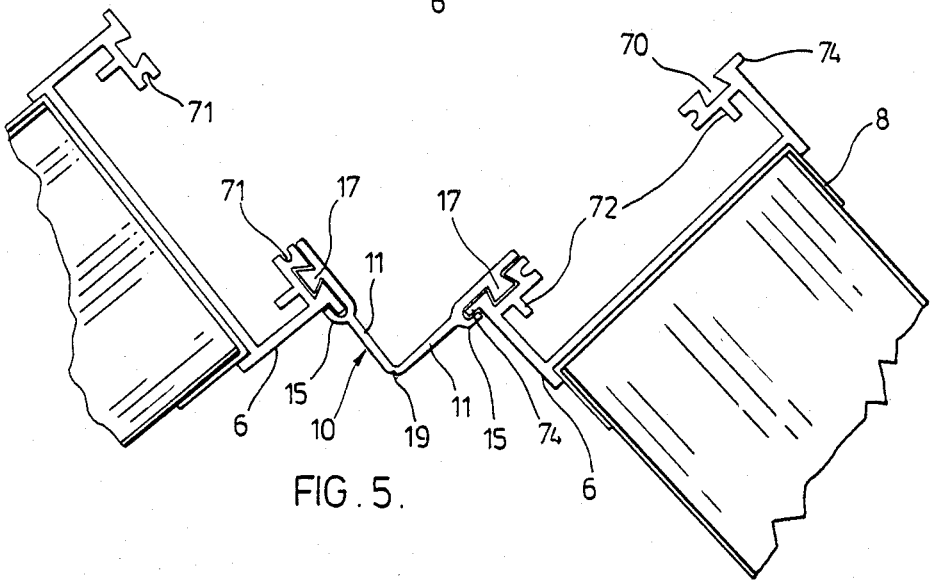
FIG. 5 is a sectional view showing the joining of two office panels frames.

Details of the extruded endcap 6 and the extruded hinge 10, preferably made of polypropylene, are shown in FIG. 5. The endcap includes two dove-tail parallel slots 70 located either side of the endcap and extending the full length thereof. These slots are sized to receive the dove-tail shaped securing bead 17 located to one end of each planar portion 11 of the hinge. Planar portions 11, are joned by a thin web 19 having a reduced thickness relative to the planar portions. Thus the pivoting of the planar members occurs about the web 19 and the planar members are fairly rigid relative to this section. Both of planar members 11 include a C-shape extension 15 which cooperates with the dove-tail 17 of each planar member to positively secure the hinge to the endcap. This C-shaped member engages the horizontally extending lip 74, either edge of the endcap, and this member effectively distributes the stress exerted on the hinge member between dovetail 17 and the C-shaped member. The planar portions 11 of the hinge, extend outwardly from the endcap in a fairly rigid manner such that two panels are pivotally connected along the hinge axis defined by the web 19. The planar members and web cooperate and thereby limit the movement of the panels relative to one another.

The hinge strip is designed to project beyond the frame of the panel to provide a hinge axis at or near the surface of the decorative panel members. This allows the hinging of panels at any angle without damaging the decorative panels which are sized to cover the frame including the extruded aluminum endcaps.

The panels shown in FIG. 5 are at an angle relative to one another however, where panels are joined in a straight line two hinge strips are secured between the abutting panels such that all planar portions 11 extend outwardly of the endcap. When two hinges are secured in this manner very little movement of the panels along the length of the panels is possible as members 11 are quite rigid and do not easily bend. This makes it possible to provide a strong connection in the longitudinal direction of the panels yet, if one hinge strip is removed, the panels may easily be angled relative to one another.

Each endcap also has two aligned slots 71 opening onto one another at the interior edges of the endcap. These slots are for receiving a planar member used to close the endcap if this end is to be exposed. In this way only the dove-tail slots 70 and lip portion 74 are exposed and the panel looks finished.

Figure 7:
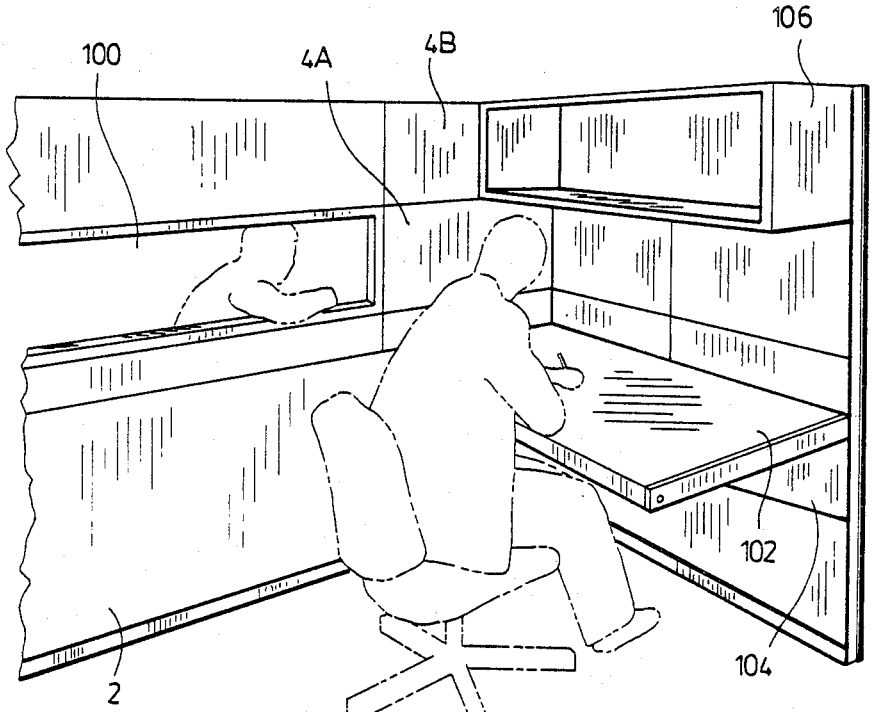
FIG. 7 is a perspective of a work station defined by joined panels including a pass through panel.

One of the benefits of this system can be seen in FIG. 7 wherein a numbers of office panels have been joined to define an office workspace. In this case three panels are in stacked relationship that being a base panel 2 and two upper panels 4A and 4B, each joined to the panel below by structural members not visible. Along one wall of this work unit a pass through panel 100 has been provided which allows communication between this work unit and the work unit on the opposite side of the wall. Due to the modular stackability of this system, the pass through unit 100 can be employed where necessary and as situations change, these units can be replaced such that a continuous wall is provided. It should also be noted that desk 102 has been cantilevered outwardly from the office panelling system and is supported in a similar manner to the office equipment as shown in FIG. 3. The lower horizontal member of compartment 20 has a shape similar to the top edge of each panel for hanging of equipment. To further support the desk 102, struts 104 are provided for distributing forces exerted on the desk. These struts are positioned to align with a vertical portion of the steel frame. The upper edge of the upper panel 4B supports filing cabinet 106 which have been suspended in the manner shown in FIG. 3. The hook securement of office accessories to the top edge of each panel or to the lower horizontal member of compartment 20 is possible through the gap defined by the slight vertical spacing of decorative panels at the junction of stacked panels or between decorative panels of a single office panel.

Figure 6:
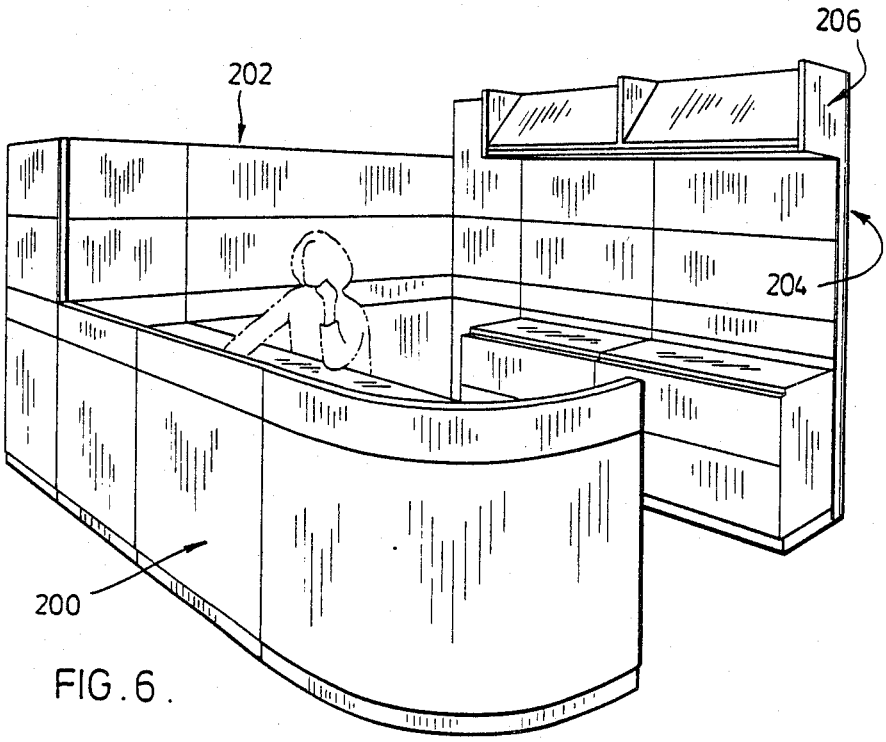
FIG. 6 is a perspective view of a reception work station, fabricated from the panels of the present office panelling system.

A further advantage of this system is shown in FIG. 6. The office work unit shown defines a reception area having low portion 200 of the reception area comprising only base units, a second wall 202 having two upper panels to provide privacy on that wall, and the rear wall 204 having four stacked panels with hanging display cases 206. Therefore, modular walls of different heights are possible which provide greater flexibility in laying out of the useable office space.

This system is of great assistance to corporations which frequently change office structure and do not find the existing layouts suitable to their needs. The panels are readily connected by the hinge strips 10 which are cut in lengths of about 15 inches to facilitate insertion within the endcaps. Stacking of panels does not require specialized tools and can easily be completed by unskilled labour. Base panel units do require the feeding of electrical wiring and telecommunication wiring although this is a fairly simple procedure. This allows field erection to be completed without the manufacturer's assistance and as such greatly simplifies distribution of the product. Custom layouts can be ordered and shipped directly to the purchaser, made up of the various standard panels and fastening hinges. The layout can be changed and the panels can be reused to reflect the changes. The office panelling system further provides power at desk height and allows the hanging of display equipment or storage equipment at various locations along the horizontal edge of the panels. In contrast to many office panelling systems, the exact location of this type of equipment is not critical as a wide degree of flexibility is possible as the bracket members are positionable along substantially the entire length of the panels.

A modified base unit of the office panelling system is disclosed in FIG. 8 and is generally designated as 250. It should be noted that because this base panel is of an alternate construction, new numbers have been assigned to the various components although they may closely correspond with components described in earlier figures. The upper edge of the structural framework for the panel is defined by member 254 having two rail portions 256 either edge of member 254 with a central and a center recess portion 255 positioned therebetween. The upper rail portion is similar to the upper edge of the earlier described office panels and is adapted to receive a bracket for hanging of various office component accessories. A number of hinges 253 are shown in position on the rails 256 and these hinges are used to support the upper decorative panel 252. The lower larger decorative panel 251 is releasably secured to the panel in a manner similar to that described in the earlier figures. The top plastic extrusion 258 is shown and is designed such that the legs 259 fit within the central recess portion 255 of the upper member 254 to provide a positive engagement therewith. The upper surface of the extrusion provides a generally planar finished surface for the top edge of the panel.

In addition, the upper member 254 has an aperture 260 which allows telecommunication wiring to either pass down through the panels or extend upwardly into the panels. The side edges of the panel are generally defined by members 262 and the endcaps 264. Each of the members 262 is preferrably of a steel material and provides the necessary vertical structural integrity of the panel. Each endcap 264 will be rivited or bolted to this member and essentially is used for connecting panels.

A number of bracing members extend in the horizontal direction of the panel and serve to define separated horizontal compartments within the panel. Bottom member 266 is of a U-shape cross-section and defines the lower edge of the panel. An aperture has been provided midway in the length to allow electrical power and telecommunication wiring to gain entrance into the panel. This power or telecommunication wiring is then brought upwardly in the panel as previously described. Immediately above the base member is a further horizontal member 278 which is also of a U-shape cross-section and has a brace 280 extending the length of the member 278. This acts as a stiffening member to avoid twisting of the panel and increases the rigidity of the structure. This member also defines a conduit to allow telecommunication wiring to pass through the various panels and also allows the wiring access to the desk height accessible space between the upper member 254 and member 268 through the conduit generally shown at 272 defined by the cover member 276 in cooperation with the channel 271. An aperture 274 is shown in member 268 and a similar aperture is located in the bottom member. Thus a telecommunication conduit is defined above and partially within the structural member 278 and below the additional structural member 269. Member 269 again horizontally extends across the width of the panel and in cooperation with member 268 and the cover 276 define an electrical conduit. As the electrical conduit must be self-contained, a similar cover member 276 would be secured to the other side of the panel however for simplicity it has not been shown.

Therefore the base office panel as shown in FIG. 8 has an upper area or compartment which is covered by the decorative panels 252. This upper area wthin the structural framework is defined by the structural member 254 in combination with the structural member 268. Immediately below this area and between structural member 268 and 269 is the electrical conduit raceway.

A small conduit is vertically located within this area to allow telecommunication wiring to pass upwardly through the electrical raceway in a manner such that it is not in communication therewith.

The upper surface of member 268 includes a central planar area having a number of apertures 270 which are sized to receive electrical receptacles with the lower portion of each receptacle extending through member 268 into the electrical raceway. Beneath the electrical raceway a telecommunication raceway is provided generally defined between the lower surface of structural member 269 and member 280. As can be appreciated each of these raceways have apertures located in both the side members 262 and the endcap 264 to allow the electrical wiring harness and the telecommunication wiring to pass between adjacent panels.

Also shown in FIG. 8 is the vertically extending joining members 282 which are slidably received within the endcap 264. These are used to join panels which are to be stacked and thus allow the system to be extended in the vertical direction. Also shown in FIG. 8 is the plastic extrusion member 284 which is received within the endcap and generally closes the center recess of the endcap.

All the horizontal members of the base panel are used to define the electrical raceway, the telecommunication raceway and the compartment at the upper edge of the panel, however, they also serve to provide structural rigidity to the base unit. It can be appreciated that a twisting moment could be exerted on the panel and these members serve to reduce the effect of this force.

Figure 11:
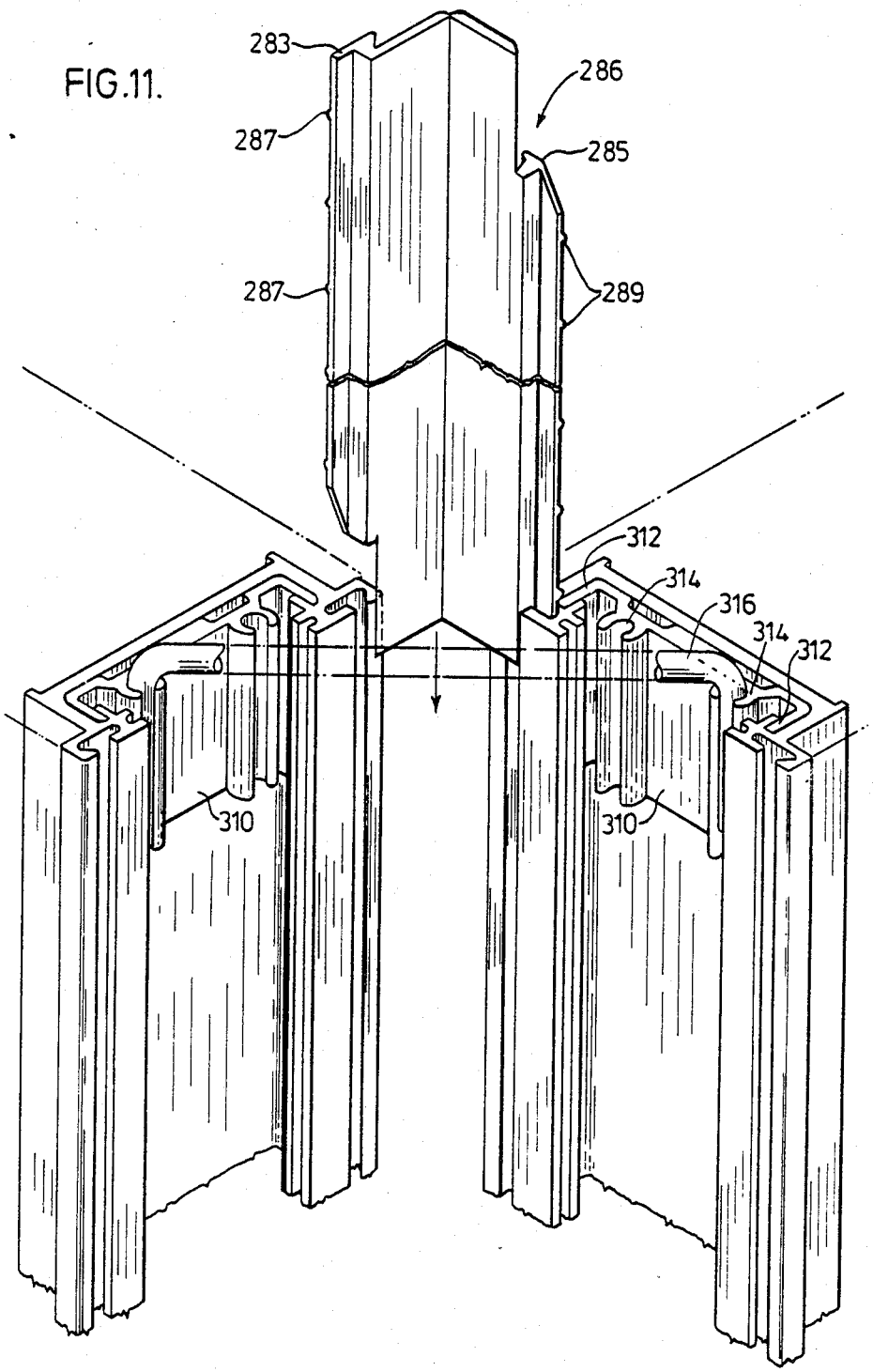
FIG. 11 is a perspective view showing two endcaps about to be secured by a modified hinge strip and also including additional components for locking the panels in a particular orientation.

In FIG. 9 a modified cross-section of the panel connecting hinge 286 member is shown. This hinge generally has two planar body members 288 and engagement beads generally designated as 291. The engagement bead has a forward engagement surface 290 which is angled relative to the body members 288 and extends toward the web 294 of the hinge. This web 294 defines the pivot axis of the hinge. Extending in the opposite direction from the forward face 290 is the rearward engagement surface 292. This rearward surface is received within the slot of the endcap and details of the slot are generally shown in FIG. 11. An outer planar surface is generally defined between the rearward and forward engagement surfaces. The hinge is made of a plastic material, preferrably made from polypropylene, and is produced by injection molding. The injection molding is required to assure the required tolerances are maintained and therefore an extrusion hinge is not suitable. The web 294 is of a reduced thickness relative to the body member to permit hinging. Also these hinges are preferrably of a length of about fifteen inches to permit insertion of the hinge progressively in sections as opposed to one continuous length.

A further injection molded hinge is shown in FIG. 10 and is used for securing the decorative panel 252 to the upper support member 254. As can be seen this hinge has two engagement lips 296 and 298 which cooperate with the center recess 255 and the lower edge of the rail 256. Thus, this member can be snapped on the upper rail and the center portion 300 can be hinged outwardly and is directly securable to the back of member 252 by engagement stud 302 engaging an aperture in the rear face of the panel. This provides a very simple manner for hingedly connecting the decorative panel 252 to the upper rail and allows access to be obtained to the upper compartment.

Further details of the injection molded panel connecting hinge and additional structural members are disclosed in FIG. 11. The injection molded hinge as shown, has been partially inserted within two endcaps of adjacent panels. Engagement bead 285 is partially inserted within a slot of the endcap while the engagement bead 283, to the opposite side of the hinge strip is in staggered relationship to the first bead and therefore has not yet engaged the slot of the adjacent endcap. This greatly simplifies insertion of the hinge strip within the endcap and can be accomplished in a number of ways such as having the engagement beads of a length less than the overall length of the hinge strip and being staggered relative to one another or one of the beads can be of a shorter length and positioned within the length of the hinge strip. The point to be noted is that the beads are to be so related such that one bead can be partially fed into the slot of an endcap independent of the other bead and the associated endcap. Furthermore the lead-in portion of the engagement bead has been angled to further facilitate insertion of the hinge.

In addition to the staggered engagement beads, engagement ridges 287 have been shown and extend across the base of the engagement bead. These ridges provide a tight fit of the engagement bead within the slot of the endcap and reduce the contact surface area between the engagement bead and the slot. The engagement ridges 289 located on the bead 285 are also staggered in relation to the engagement ridges 287 located on the opposite engagement bead 283. This again allows one of the beads to engage within the slot and then allows the other bead to become snug in the slot and thus allows the hinge to be progressively inserted within the slots of the endcap. These ridges and the modified construction of the engagement beads allow easier insertion of the hinge in the endcaps.

Connecting members 310 have been inserted in each of the endcaps. These members have arms 312 which slidably engage within the center recess of the endcap and also have further engagement slots 314. As can be seen members 310 can be slidably received within the endcap and maintained in place either by a rivet or a screw, not shown. Once bridging a structural member 316 can be inserted within the slots 314 to thereby rigidly connect two endcaps in a particular orientation. This further stiffens the overall system and avoid inadvertent relocation of one panel relative to the other.

Figure 12:
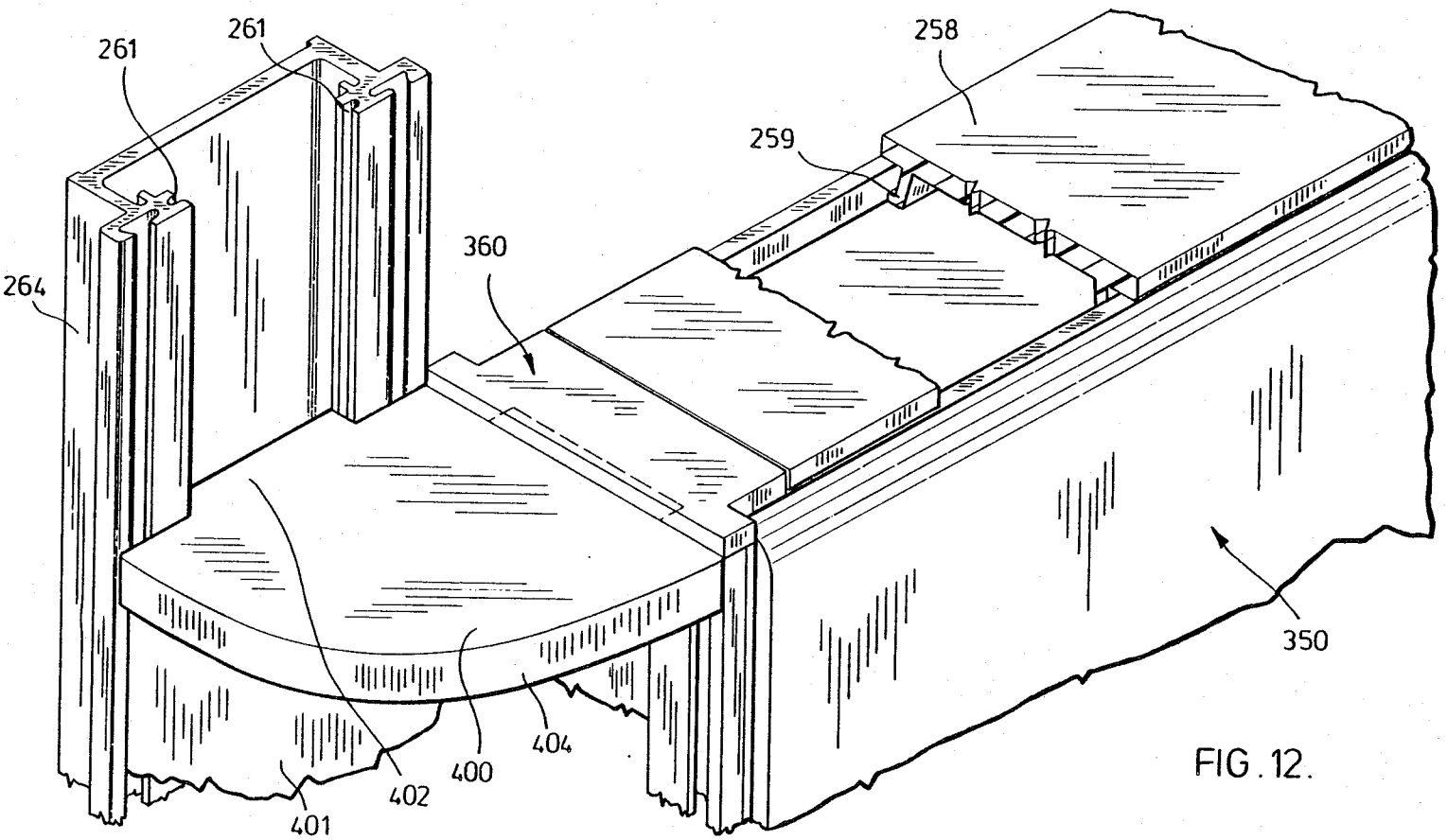
FIG. 12 is a partial perspective view showing a corner detail when two panels are secured and one of the panels is at a different height than that of the other panel.

FIG. 12 shows further detail of the top extrusion 258 which is inserted within the upper surface of a panel. The extrusion has legs 259 which provide a snug fit within the center recess. In addition an end piece 360 is shown which is positively received within the endcaps. In order to provide a transition between the space defined by two adjacent panels at an angle, a cap member 400 may be provided which is slidably received within the center recess and engaged thereby. A similar engagement is provided with respect to the endcap of panel 350. These caps have a extending portion 402 to be received within the recess of the endcap and also have a lower skirt 404 to provide a more finished contour with respect to the vertical direction. Optionally a skirt member may be provided to enclose the area beneath cap 400. Details of the end piece for the endcap are shown in FIG. 13 where it can be seen that member 362 has a lower extending member 364 and a rearwardly extending member 366. The upper planar surface is provided by surface 362. Member 364 engages within the slot 261 of the endcap and the rearward portion 366 engages beneath the top extrusion 258. These injection molded caps are provided to finish the top edge of any exposed endcaps.

Details of other endcaps are shown in FIGS. 14 through 16 with various types of members being shown. In each case there are a number of extending tabs which engage within the slots of an endcap. In FIG. 14 cap member 410 is disclosed and is used to cover the space defined by four panels joined together in a cross configuration. Each of the members 412 are engagable within one of the slots 261 of an endcap.

In FIG. 15 a modified endcap is shown for joining two panels at an angle relative to one another. As can be appreciated this is for a fixed orientation of the panels. The cap generally shown as 430, has two extending tab members 432 for engagement within the two panels disposed at an angle relative to one another.

In FIG. 16 a further endcap is shown generally designated as 440 having extending tabs 442 for engagement within the slot. This cap would be used for joining three adjacent panels.

As can be appreciated these caps are specialized and the panels must be maintained at a certain angle relative to one another. The purpose of the caps is to provide a finished surface and essentially closes the area defined between two joined adjacent panels. The connecting members of FIG. 12 are advantageously used in combination with the endcaps of FIGS. 14 through 16.

Although various preferred embodiments of the present invention have been described herein in detail it will be appreciated by those skilled in the art that variations may be made thereto without departing from the spirit of the invention or the scope of the appended claims.

The embodiments of the invention in which an exclusive property or privilege is claimed are defined as follows:

1. In an office panelling system having a plurality of free standing panels horizontally connected to adjacent panels by hinge strips a portion of which are slidably received in said adjacent panels, at least some of said panels having a steel generally rectilinear framework which is divided horizontally in the height thereof by a horizontal member dividing said panel into separate and distinct upper and lower horizontally extending compartments, said horizontal member receiving at least one electrical receptacle which extends through said horizontal member into said lower compartment for connection to a power supply and is exposed within said upper compartment to receive electrical plugs of office equipment within said upper compartment and interior to said panel, said upper and lower compartments each having separate decorative panels removably secured to said framework to close the sides thereof, said upper compartment being separately accessible by removing said separate upper compartment decorative panel to access said electrical receptacle for receipt of electrical plugs of office equipment in said receptacle and to store excess electrical cord of such office equipment within said upper compartment, and means for accommodating such cord to extend between said upper compartment and the panel exterior.

2. In an office panelling system as claimed in claim 1 said horizontal member being of a section to define raised lip portions either side of said framework, said decorative panels being vertically spaced to provide a gap therebetween through which said raised lip portions are accessed to permit hook securement of office accessories either side of said panel and at any point substantially in the length of said horizontal member, said raised lip portions being interconnected by a flat planar area of sufficient width for receiving said at least one electrical receptacle.

3. In an office panelling system as claimed in claim 1 wherein the decorative panel of said upper compartment is horizontally hinged at the upper edge thereof to provide access to said compartment and wherein said means for accommodating includes a resilient member at a lower edge of said upper compartment panel.

4. In an office panelling system as claimed in claim 3 wherein said upper compartment starts at approximately 30 inches above floor level.

* * * * *